United States Patent [19]

Hauck

[11] 4,108,397

[45] Aug. 22, 1978

[54] CADDY FOR KNITTING AND CROCHETING YARN

[76] Inventor: Dorothy M. Hauck, 415 E. Division St., Lockport, Ill. 60441

[21] Appl. No.: 797,534

[22] Filed: May 16, 1977

[51] Int. Cl.[2] ..... B65H 49/18

[52] U.S. Cl. ..... 242/137.1; 242/146

[58] Field of Search ..... 242/137, 137.1, 134, 242/136, 146; 206/391-394; 223/106; 112/218 R

[56] References Cited

U.S. PATENT DOCUMENTS

| | | | |
|---|---|---|---|
| 349,440 | 9/1886 | Looker | 242/137.1 |
| 2,148,860 | 2/1939 | Huber | 242/137 |
| 2,185,755 | 1/1940 | Schnider | 242/137 |

*Primary Examiner*—Leonard D. Christian

*Attorney, Agent, or Firm*—Clarence A. O'Brien; Harvey B. Jacobson

[57] ABSTRACT

An upwardly opening generally rectangular receptacle including two pairs of opposite side walls is provided and a plurality of side-by-side upwardly opening generally semi-cylindrical bottom wall portions extend between and are supported from lower marginal portions of one pair of the side walls. A cover is removably secured over the top of the receptacle and adjacent portions of the semi-cylindrical bottom wall portions merge into upstanding partitions whose upper marginal edges are abutted by the top wall. The side walls project downwardly below the bottom wall portions and the latter define a false bottom, a bottom structure being removably secured under the lower marginal edges of the side walls defining a storage area between the upper side of the bottom structure and the under surface portions of the semi-cylindrical bottom wall portions. The top wall is provided with openings therethrough for receiving yarn strands from hanks of yarn resting upon the semi-cylindrical bottom wall portions and one peripheral portion of the receptacle is provided with a bail-type handle swingably supported therefrom and shiftable between a carrying handle defining position and a receptacle propping position whereby the receptacle may be propped in an inclined position on a horizontal surface.

10 Claims, 9 Drawing Figures

Fig. 4
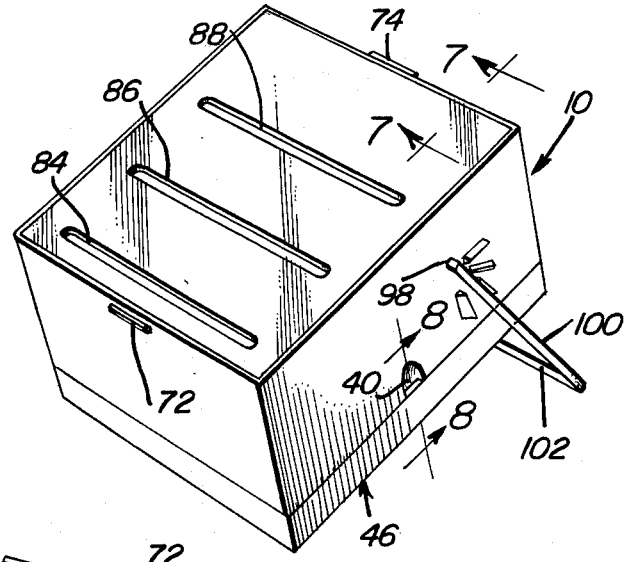
Fig. 5
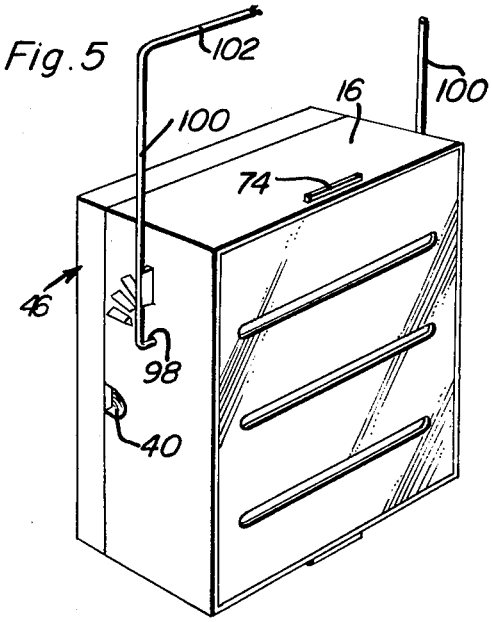
Fig. 6
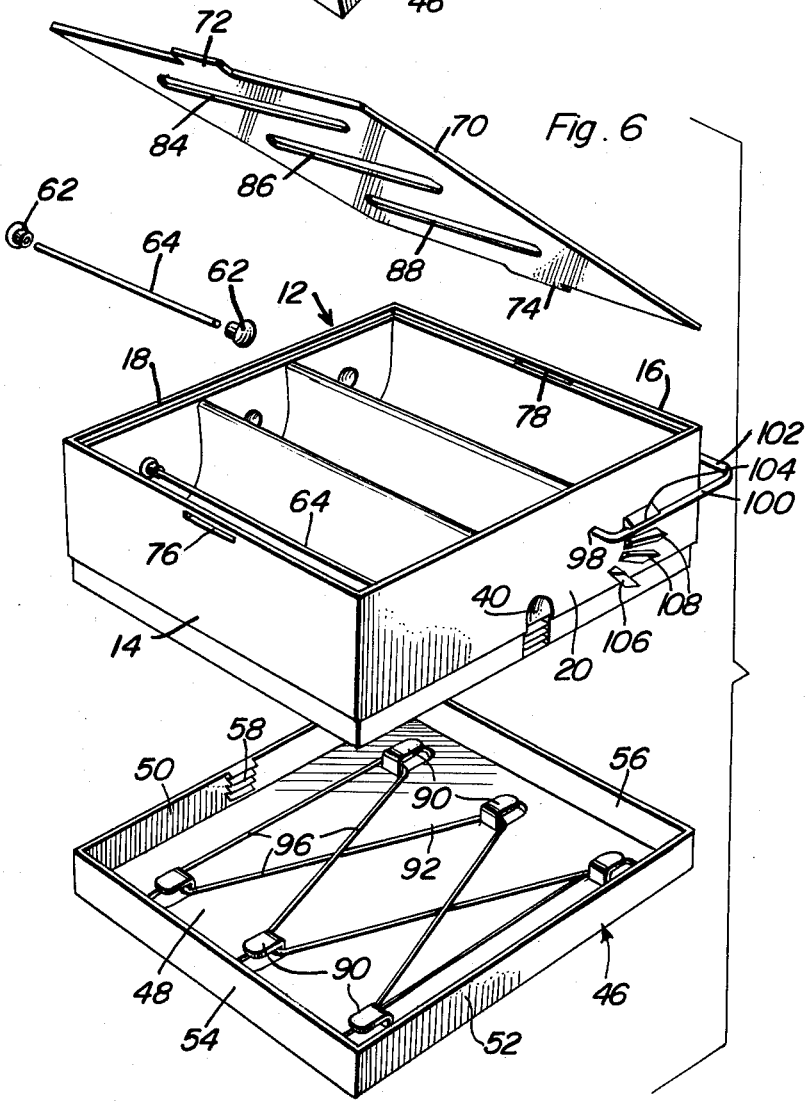
Fig. 7
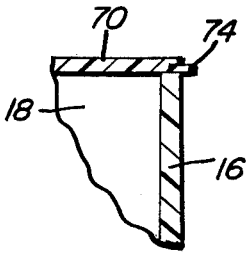
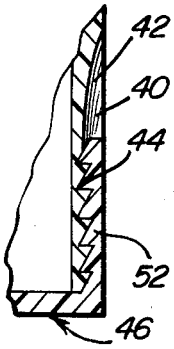
Fig. 8
Fig. 9
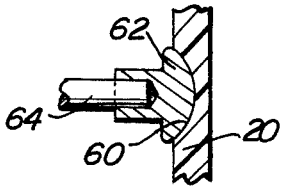

CADDY FOR KNITTING AND CROCHETING YARN

BACKGROUND OF THE INVENTION

Various forms of caddies for crocheting and knitting yarn have been heretofore provided. However, most of these previously known caddies have been designed to be utilized in conjunction with one specific type of yarn or thread and are not readily adaptable for use in conjunction with various types of yarns or threads. Further, previously known caddies are, for the most part, cumbersome to carry and not readily positionable in an optimum position during knitting and crocheting operations. Still further, some caddies are expensive to produce and, therefore, prohibitive in cost, at least to some persons who enjoy knitting and crocheting.

Examples of various forms of previously known caddies, including some of the general structural and operational features of the instant invention, are disclosed in U.S. Pat. Nos. 349,440, 1,354,598, 1,731,347, 2,185,755, 2,264,664, 2,304,501 and 2,519,505.

BRIEF DESCRIPTION OF THE INVENTION

The caddy of the instant invention comprises an upwardly opening generally rectangular housing including side-by-side upwardly opening semi-cylindrical bottom wall portions extending between and supported from one pair of opposite walls of the housing. The bottom wall portions define individual upwardly opening recesses in which to receive hanks of yarn and a cover is removably secured over the top of the housing and includes openings therethrough in registry with the recess in which the hanks of yarns are received. The openings are provided to slidingly receive yarn strands therethrough. In addition, the sides of the receptacle extend downwardly below the upwardly opening semi-cylindrical bottom wall portions and the housing includes a horizontal bottom secured under the lower marginal edges of the sides of the housing defining a storage area between the horizontal bottom and the false bottom defined by the semi-cylindrical bottom wall portions.

The upper surface of the horizontal bottom includes structure whereby knitting accessories may be removably supported therefrom and the opposite sides of the housing between which the semi-cylindrical bottom wall portions extend support elongated shafts therebetween extending generally along the axes of curvature of the semi-cylindrical bottom wall portions. The shafts are removably supported within the housing and may be lengthwise inserted through skeins of yarn to be received in the upwardly opening recesses defined by the semi-cylindrical bottom wall portions. In this manner, the skeins of yarn may be rotatably supported from the shafts.

The main object of this invention is to provide a caddy for crocheting and knitting yarns and which may be conveniently utilized to house and transport various skeins of yarn.

Another object of this invention is to provide a caddy which may be maintained in a substantially closed condition and yet have strands of yarn pulled therefrom as required during kniting and crocheting operations.

Another important object of this invention is to provide a caddy including a convenient handle for manual carrying from one location to another and with the handle supported from the caddy in a manner such that it may be utilized to prop the caddy in a desirable inclined position from a horizontal support surface when knitting or crocheting operations are being carried out.

A still further object of this invention is to provide a caddy constructed in a manner whereby various knitting and crocheting accessories may be housed within the caddy in a compartment therein independent of individual compartments within the caddy for receiving skeins of yarn.

A final object of this invention to be specifically enumerated herein is to provide a caddy constructed in accordance with the preceding objects and which will conform to conventional forms of manufacture, be of simple construction and easy to use so as to provide a device that will be economical feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a perspective view of the caddy on a reduced scale and with the bail-type handle thereof in position to define a prop for the caddy;

FIG. 5 is a fragmentary, perspective view of the caddy with the bail-type handle thereof in a handle defining position to facilitate carrying of the caddy;

FIG. 6 is an exploded, perspective view of the caddy;

FIG. 7 is an enlarged, fragmentary, vertical, sectional view taken substantially upon the plane indicated by the section line 7—7 of FIG. 4;

FIG. 8 is an enlarged, fragmentary, vertical, sectional view taken substantially upon the plane indicated by the section line 8—8 of FIG. 4; and, FIG. 9 is an enlarged, fragmentary, vertical, sectional view illustrating the manner in which the skein support shafts are removably supported within the receptacle portion of the caddy.

DETAILED DESCRIPTION OF THE INVENTION

Figure 1:
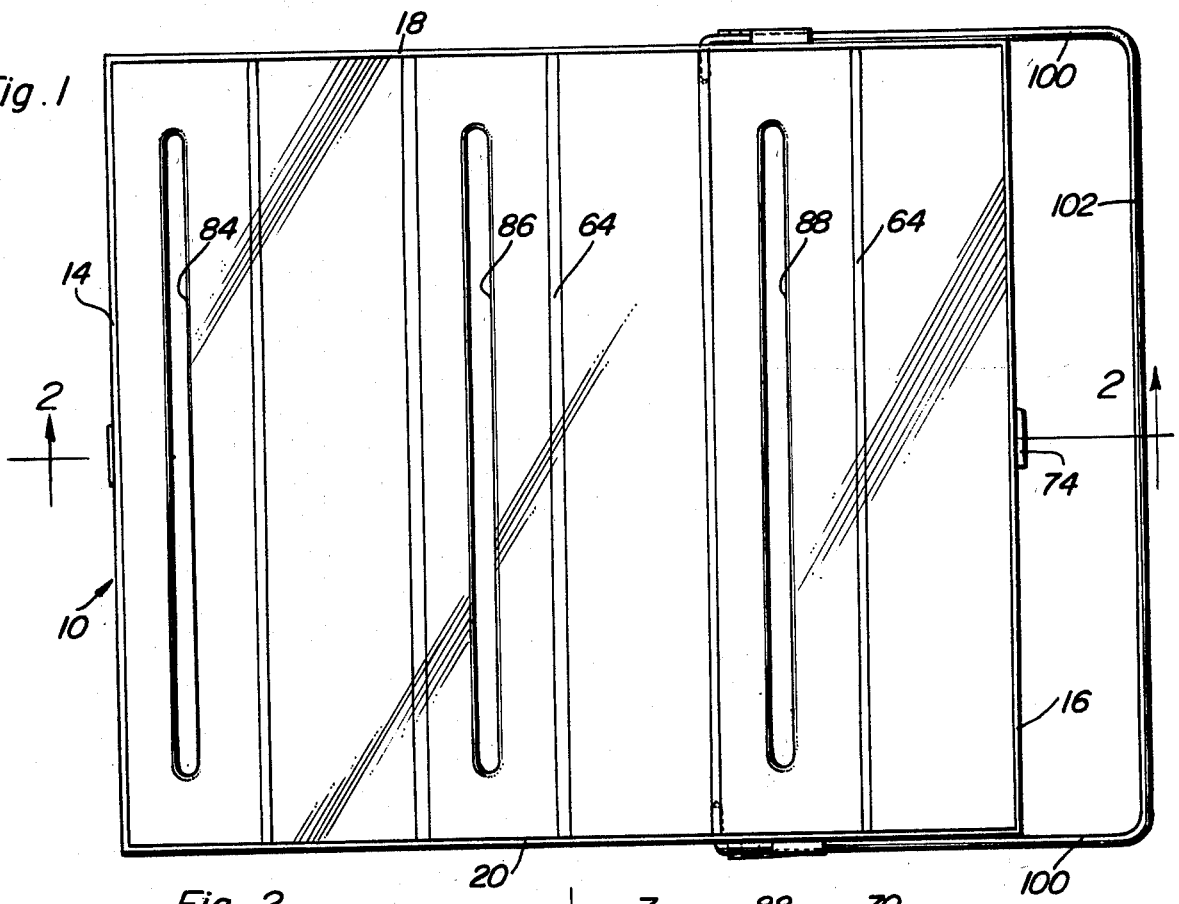
FIG. 1 is a top plane view of the caddy of the instant invention.

Referring now more specifically to the drawings, the numeral 10 generally designates the caddy of the instant invention. The caddy 10 includes a generally rectangular open top housing referred to in general by the reference numeral 12 including a pair of opposite end walls 14 and 16 interconnected by means of a pair of opposite side walls 18 and 20 extending therebetween and formed integrally therewith. The housing 12 includes a false bottom wall 22 including a plurality of side-by-side upwardly opening semi-cylindrical bottom wall portions 24, 26 and 28 formed integrally with each other and the end walls 14 and 16 and extending between and formed integrally with the side walls 18 and 20. The adjacent portions of the bottom wall portions 24, 26 and 28 merge to form upstanding partitions 30 and 32 defining the interior of the housing 12 above the false bottom wall 22 into individual upwardly opening recesses 34, 36 and 38 closed at their lower ends by means of the bottom wall portions 24, 26 and 28, respectively.

The lower marginal portions of the side walls 18 and 20 include outwardly opening shallow recesses 40 including smooth upper portions 42 and toothed lower portions 44. A bottom structure referred to in general by the reference numeral 46 is provided and includes a bottom panel 48, upstanding opposite side flanges 50 and 52 and upstanding opposite end flanges 54 and 56. Longitudinal midportions of the side flanges 50 and 52 include inwardly projecting teeth 58 and 60 and the bottom structure 46 is telescopingly engageable over the lower portion of the housing 12 with the flanges 50, 52, 54 and 56 telescoped upwardly over the reduced thickness lower marginal portions of the side walls 18, 20, 14 and 16, respectively, and with the teeth 58 removably engaged with the toothed lower portions 44 in order to releasably retain the bottom structure 46 on the underside of the housing 12. The upper portions 42 of the recesses 40 may have fingernails of a person engaged therein to outwardly bias the toothed midportions of the side flanges 50 and 52 whereby the bottom structure 46 may be released from engagement with and displaced away from the lower end of the housing 12.

The inner surfaces of the side walls 18 and 20 include inwardly opening partial spherical recesses 60 in which partial spherical heads 62 carried by the opposite ends of cylindrical shafts or rods 64 are removably seatingly engaged. Accordingly, the rods 64 are removably supported in the recesses 34, 36 and 38 generally concentric with the axes of curvature of the bottom wall portions 24, 26 and 28. Accordingly, the rods 64 may be longitudinally advanced centrally through elongated generally cylindrical skeins of yarn and utilized to support the skeins of yarn within the recesses 34, 36 and 38, the skeins of yarn being readily rotatable on the rods 64. However, the rods 64 may be omitted and the skeins may be rotatably cradled by the upwardly opening semi-cylindrical bottom wall portions 24, 26 and 28 upon which the skeins of yarn rest.

The upper marginal edges of the side walls 18 and 20 and end walls 14 and 16 are stepped and a top wall 70 is provided and includes opposite end tabs 72 and 74 receivable through openings 76 and 78 formed in the upper marginal portions of the end walls 14 and 16. Of course, the end walls 14 and 16 are slightly flexed apart in order to receive the extensions 72 and 74 in the openings 76 and 78. In this manner, the top wall or panel 70 may be removably supported in position closing the top of the housing 12 with the panel or top wall 70 flush with the upper marginal edges of the walls 14, 16, 18 and 20. In addition, the panel or top wall 70 includes longitudinally spaced transverse slots 84, 86 and 88 formed therein in registry with the recesses 34, 36 and 38, but disposed in vertical planes horizontally offset from the longitudinal centers of the recesses 34, 36 and 38.

The bottom structure 46 includes integral upwardly struck and offset tabs 90 spaced transversely thereof at the opposite ends of the bottom structure 46 and an elongated elastic tension member 92 is trained about the tabs 90 in a manner to define a plurality of reaches 96 of the tension member 92 beneath with knitting and crocheting accessories may be secured.

The side walls 18 and 20 include outwardly opening sockets 98 and inturned terminal ends of the parallel legs 100 of a bail-type handle 102 are rotatably received in the sockets 98 whereby the handle 102 is swingably supported from the housing 12. The opposite side walls 18 and 20 of housing 12 include stop abutments 104 and 106 defining limits of angular displacement of the handle 102 by engagement of the legs 100 with the abutments 104 and 106 and the side walls 18 and 20 include intermediate abutments 108 between the corresponding abutments 104 and 106 and the intermediate abutments may be engaged by the legs 100 of the handle 102 in order to releasably secure the handle 102 in adjusted angularly displaced positions relative to the housing 12.

Figure 2:
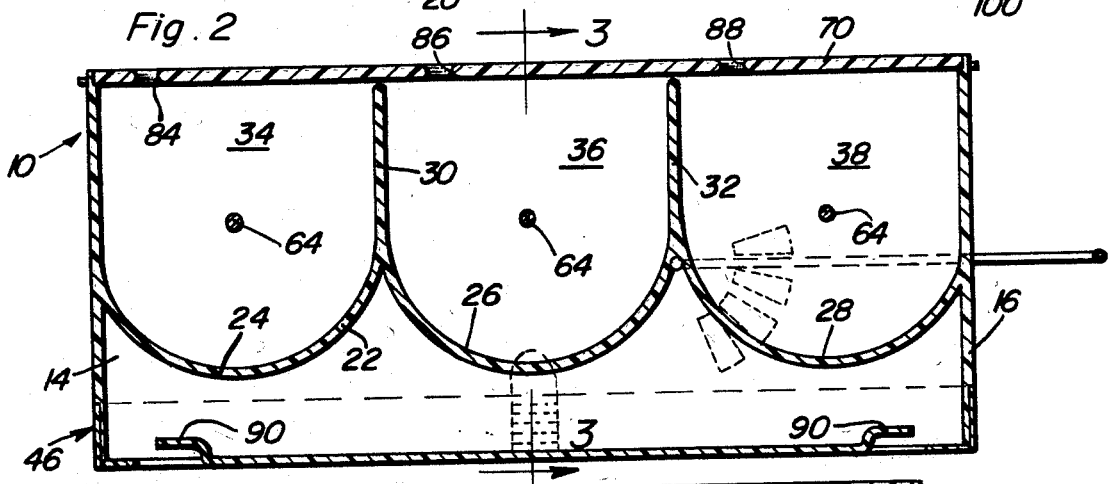
FIG. 2 is a vertical, sectional view taken substantially upon the plane indicated by the section line 2—2 of FIG. 1.
Figure 3:
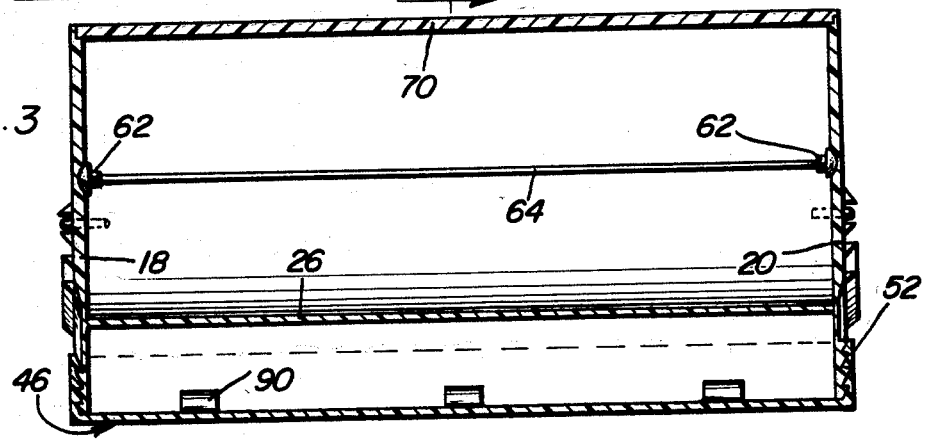
FIG. 3 is a vertical, sectional view taken substantially upon the plane indicated by the section line 3—3 of FIG. 2.

When the handle 102 is in the position thereof illustrated in FIG. 2 of the drawings, it may be utilized as a handle for carrying the caddy 10 from one location to another. However, the handle 102 may be swung to and releasably secured in the position thereof illustrated in FIG. 4 of the drawings whereby the caddy 10 may be propped in an advantageous inclined position relative to a horizontal support surface therefor when knitting and/or crocheting operations are being carried out and knitting and/or crocheting yarn is being pulled from the caddy 10.

The housing 12 exclusive of the cover or top wall 70 and the bottom wall structure 46 is constructed integrally of any suitable form of plastic and the top wall or cover 70 may be constructed of transparent plastic. Further, the bottom structure 46 is also constructed of plastic.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A caddy for various yarns to be used in knitting and crocheting, said caddy including an upwardly opening receptacle defining a plurality of upwardly opening individual recesses defined by upwardly concave bottom wall portions, a cover removably secured over the top of said receptacle and including openings formed there-through in vertical registry with said recesses and operative to slidingly receive yarn sections therethrough wound into hanks disposed in said recesses, said receptacle including two pairs of opposite upstanding sides, said bottom wall portions being semi-cylindrical and formed integrally with each other and said sides and extending lengthwise between one pair of said sides, said sides extend downwardly below said bottom wall portions and the latter define a false bottom for said receptacle, and a generally horizontal bottom structure removably secured under said sides and defining a storage area between said horizontal bottom structure and said false bottom.

2. The combination of claim 1 wherein said receptacle is generally rectangular in plan shape.

3. The combination of claim 1 wherein the adjacent portions of said bottom wall portions merge into upstanding partitions extending between said one pair of said sides, said cover including an undersurface abuttingly engaged with the upper marginal edge portions of said partitions.

4. The combination of claim 1 wherein said horizontal bottom structure includes upwardly projecting anchor portions spaced horizontally thereover, and elongated elastic means extending over said bottom structure and trained about said anchor portions.

5. A caddy for various yarns to be used in knitting and crocheting, said caddy including an upwardly opening receptacle defining a plurality of upwardly opening individual recesses defined by upwardly concave bottom wall portions, a cover removably secured over the top of said receptacle and including openings formed there-through in vertical registry with said recesses and operative to slidingly receive yarn sections therethrough wound into hanks disposed in said recesses, said receptacle includes two pairs of opposite upstanding sides, said bottom wall portions being semicylindrical and formed integrally with each other and said sides and extending lengthwise between one pair of said sides, said one pair of opposite side walls including inwardly opening recesses generally centered with the axes of curvature of said bottom wall portions, and a support rod disposed in each upwardly opening recess with its opposite ends removably supportingly received in the corresponding inwardly opening recesses.

6. A caddy for various yarns to be used in knitting and crocheting, said caddy including an upwardly opening receptacle defining a plurality of upwardly opening individual recesses defined by upwardly concave bottom wall portions, a cover removably secured over the top of said receptacle and including openings formed there-through in vertical registry with said recesses and operative to slidingly receive yarn sections therethrough wound into hanks disposed in said recesses, one end portion of said receptacle includes a pivoted bail-type handle, said handle being swingable between a first position projecting endwise outwardly of said one end portion of said receptacle and a second position projecting outwardly of the bottom of said receptacle disposed generally normal to the longitudinal extent thereof, said receptacle and handle including means operative to releasably retain said handle in said first and second positions as well as a plurality of relatively angularly displaced positions there-between.

7. A caddy for various yarns to be used in knitting and crocheting, said caddy including an upwardly opening receptacle defining a plurality of upwardly opening individual recesses defined by upwardly concave bottom wall portions, a cover removably secured over the top of said receptacle and including openings formed therethrough in vertical registry with said recesses and operative to slidingly receive yarn sections therethrough wound into hanks disposed in said recesses, said receptacle including two pairs of opposite upstanding sides, said bottom wall portions being semicylindrical and formed integrally with each other and said sides and extending lengthwise between one pair of said sides, the inner portions of the upper marginal edges of said sides being stepped for receiving said cover between the stepped upper marginal edges of said sides.

8. The combination of claim 7 wherein one pair of said sides includes a pair of horizontal slots formed therethrough in the stepped portions thereof, said cover including opposite marginal outwardly projecting tongue extensions removably received in said slots.

9. The combination of claim 5 wherein, the outer portions of the lower marginal edges of said sides are stepped, said bottom structure include upstanding peripheral flange portions removably upwardly telescoped over said stepped lower marginal edges of said sides.

10. The combination of claim 9 wherein the telescoped portions of one pair of opposite sides and flanges include interfitted tooth portions removably securing said bottom structure to said receptacle.

* * * * *